US006781303B2

(12) United States Patent
Kovacs

(10) Patent No.: US 6,781,303 B2
(45) Date of Patent: Aug. 24, 2004

(54) MERCURY VAPOR LAMP AMALGAM TARGET

(75) Inventor: George Kovacs, Wallingford, CT (US)

(73) Assignee: Light Sources, Inc., Orange, CT (US)

( * ) Notice: Subject to any disclaimer, the term of this patent is extended or adjusted under 35 U.S.C. 154(b) by 314 days.

(21) Appl. No.: 10/003,273

(22) Filed: Dec. 6, 2001

(65) Prior Publication Data

US 2003/0048069 A1 Mar. 13, 2003

Related U.S. Application Data

(60) Provisional application No. 60/318,441, filed on Sep. 10, 2001.

(51) Int. Cl.[7] ..... H01J 1/62; H01J 63/04

(52) U.S. Cl. ..... 313/490; 313/484; 313/493; 313/565; 313/635; 313/639

(58) Field of Search ..... 313/490, 484, 313/489, 493, 565, 567, 635, 636, 639

(56) References Cited

U.S. PATENT DOCUMENTS 3,001,269 A 9/1961 Meere et al.
3,263,111 A 7/1966 Doering
3,281,174 A 10/1966 Heil
3,296,692 A 1/1967 Griffin
3,657,589 A 4/1972 Porta et al.
3,860,852 A 1/1975 Latessa et al.
3,963,954 A * 6/1976 Milke et al. ..... 313/489
4,020,378 A 4/1977 Morehead
4,105,910 A 8/1978 Evans
4,288,715 A 9/1981 van Overveld et al.
4,467,238 A * 8/1984 Silverstein et al. ..... 313/25
5,229,687 A * 7/1993 Fowler et al. ..... 313/565
5,539,277 A * 7/1996 Jansma ..... 313/489
5,952,780 A * 9/1999 Forsdyke et al. ..... 313/565

* cited by examiner

*Primary Examiner*—Ashok Patel
*Assistant Examiner*—Kevin Quarterman
(74) *Attorney, Agent, or Firm*—Robert A. Seemann

(57) ABSTRACT

A mixture of indium metal and titanium metal is fused to the inner surface of a quartz envelope of a mercury vapor discharge lamp.

10 Claims, 2 Drawing Sheets

MERCURY VAPOR LAMP AMALGAM TARGET

This application claims the benefit of U.S. Provisional Application No. 60/318,441, filed Sep 10, 2001.

BACKGROUND OF THE INVENTION

1. Field of the Invention

The invention pertains to mercury vapor discharge lamps. More particularly to a target on the quartz envelope surface that faces the electrical discharge within the lamp, that forms an amalgam from the mercury vapor within the envelope.

2. Description of the Prior Art

In many mercury vapor lamps in use, a small bead of indium is fused onto a micron thin layer of gold coating on the inside surface of the quartz envelope of the low pressure mercury vapor discharge lamp. The indium later forms an amalgam with the mercury vapor in the lamp for vapor concentration control purpose.

U.S. Pat. No. 3,263,111 patented Jul. 26, 1966 by U.W. Doering describes adding an amalgam body consisting of mercury plus gold, silver, tin or potassium to the inner wall of a flourescent tube to control the level of mercury vapor pressure within the tube. U.S. Pat. No. 3,263,111 is hereby incorporated by reference.

U.S. Pat. No. 4,020,378 patented Apr. 26, 1977 by Morehead describes a bit made of indium and tin pressed against the glass stem within the tube while the glass is heated and the bit fuses to the glass. Larger bits are held in place by an overlying porous layer of inert material.

SUMMARY OF THE INVENTION

It is one object of the invention to fuse indium to the surface of the quartz envelope of a mercury vapor lamp.

It is another object of the invention to fuse an indium and titanium mixture to the surface of the quartz envelope of a mercury vapor lamp.

It is another object of the invention to provide an indium and titanium target fused on the inside surface of the quartz envelope of a mercury vapor lamp for formation of an amalgam from mercury that is added to the tube.

A low pressure mercury vapor discharge lamp includes a hermetically sealed envelope. The wall of the envelope includes an elongated quartz tubular portion. At least one thermionic electrode, mercury vapor, and at least one inert gas are in the envelope. A mixture comprising indium metal and titanium metal fused together and to the inside of the quartz tubular portion is spaced from the electrode toward the center of the tubular portion, and is exposed to the mercury vapor.

A method for making a low pressure mercury vapor discharge lamp includes the steps of inserting a thermionic electrode in a first end of a quartz tube that is transparent to radiation products of low pressure mercury vapor discharge, hermetically sealing the first end of the tube around electrical leads from the electrode, placing a measured amount of indium metal combined with titanium metal on the inside surface of the quartz tube, applying heat to the quartz until the indium and titanium are melted and fuse to the quartz tube, and inserting mercury into the tube.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
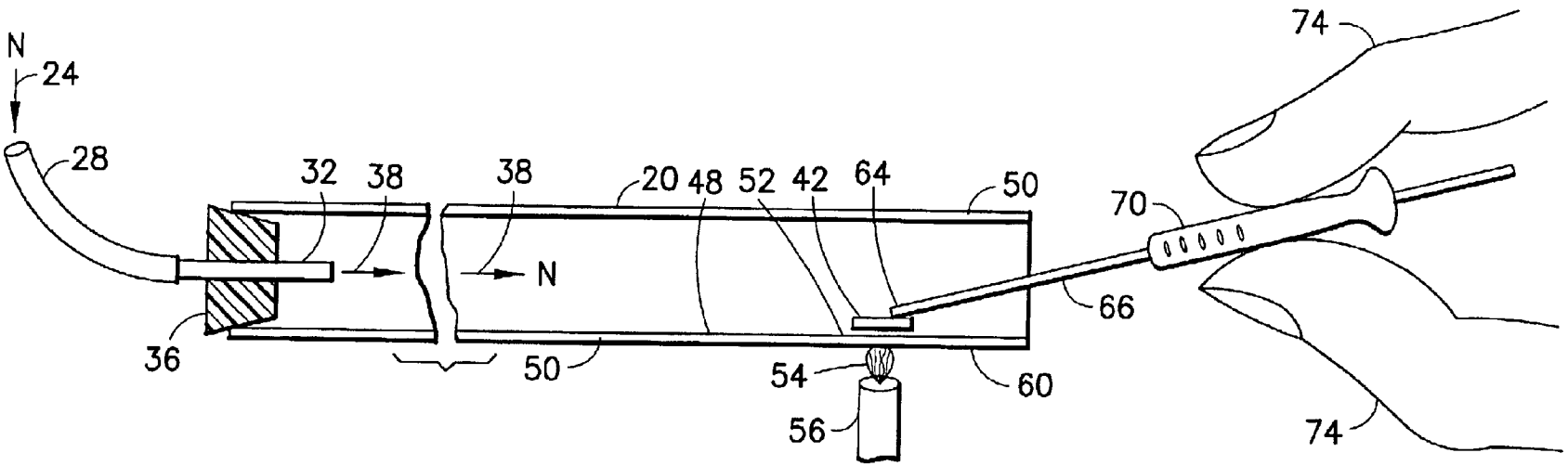
FIG. 1 is a schematic view of a target for amalgam formation, being applied to the inner surface of the quartz envelope according to the invention.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

In a preferred method according to the invention, referring to FIG. 1, quartz tube 20 is filled with nitrogen gas N from source 24 by way of flexible delivery tube 28, through glass pipe 32 which passes through rubber stopper 36. The nitrogen flows 38 through tube 20 at about 20–30 cubic feet per hour, thereby excluding oxygen and other reactive gasses from the tube.

Quartz tube 20 is transparent to the radiation that is intended to be provided by the lamp, be it radiation from the discharge or from secondary emission by materials that will be in the tube that are responsive to the discharge. For example, flourescent material that emits visible light in response to radiation from the discharge can be added to the tube.

Indium wire 42, free of grease and other contaminants, folded into a compact shape, is placed on inner surface 48 of clean area 52 of quartz wall 50. Inner surface 48 in area 52 does not contain gold.

Flame 54 of a gas burner 56 is applied to outside surface 60 of wall 50 under the folded indium wire until the indium melts. The indium forms a ball as it melts.

While the indium ball is red hot, end 64 of titanium wire 66 that is held in insulated sleeve 70 by an operator's fingers 74 is inserted into the molten indium and rubbed on inner surface 48 in area 52 in a circular motion until the movement forms a metal spot on the surface of the quartz that is wetted with the indium-titanium mixture.

The nitrogen atmosphere in tube 20 is maintained while the metal mixture cools and changes from the molten liquid metal to a hard metal state, to keep the titanium and the indium of the target from being oxidized by air.

Figure 2:
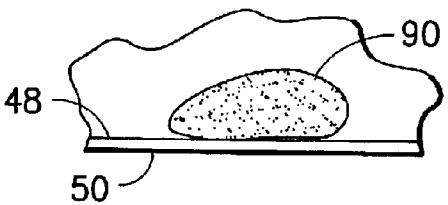
FIG. 2 is a schematic view of a sintered element for another target according to the invention.

In another method of the invention, referring to FIG. 2, element 90 is a mixture of indium and titanium. Element 90 is placed on a clean portion of the inner surface 48 of the quartz wall 50 of the tube. Element 90 and adjacent tube portion is heated so that element 90 melts and fuses to the surface of the quartz. Particle size of the indium and the titanium is made small so that the metals mix when element 90 is melted.

When the tube is sealed forming the lamp envelope, the envelope contains mercury that was added to the envelope. Part of the mercury in the envelope forms an amalgam with the indium and titanium target.

Figure 3:
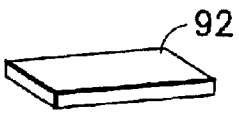
FIG. 3 is a schematic view of a ribbon element for another target according to the invention.

In another method of the invention, referring to FIG. 3, element 92 is a ribbon made of indium and titanium melted together in uniform mixture. A length of element 92 is placed on a clean portion of the inner surface of the quartz wall of the tube and is melted to the inner surface of the tube. The indium and titanium may be compressed, melted, or sintered together and then placed on the quartz wall for melting to the surface of the quartz wall.

In another method of the invention, $Al_2O_3$ in fine particle size is applied on inner surface 48 of the quartz tube before the indium and titanium is fused to the inner surface of quartz wall 50 of the tube. The indium-titanium is heated, preferably by heating outer surface 60 of the tube and the indium-titanium fuses to the quartz wall containing the $Al_2O_3$ without the aid of gold. As gold is not needed for the bonding, gold is not used for the bonding and for that reason is not present in the bond, but gold can be added if desired.

In a preferred arrangement, the aluminum oxide $Al_2O_3$ in particle size of about 25 to 50 microns dispersed about 10% $Al_2O_3$ in $H_2O$, is applied to the inside surface of the quartz envelope and heated before the indium and titanium are applied to the inner surface containing $Al_2O_3$ of the quartz envelope.

In a preferred arrangement the indium metal and the titanium metal are each 99.99% pure. 99.2% pure titanium is acceptable for use in the invention.

Figure 4:
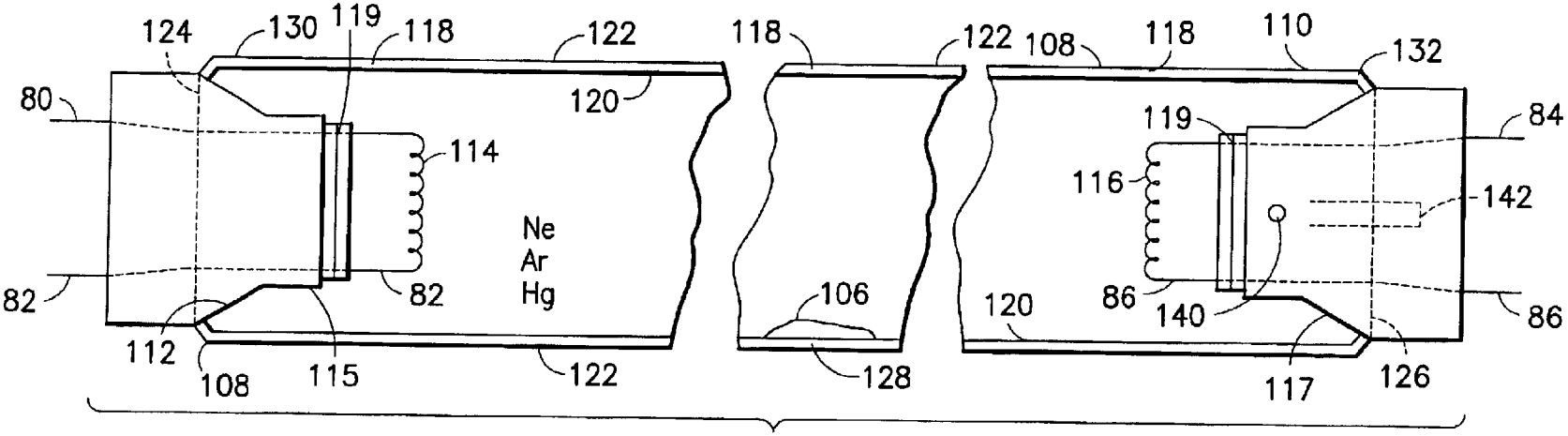
FIG. 4 is a schematic view of a mercury vapor lamp comprising the invention.

Referring to FIG. 4, elongated envelope 108 of germicidal lamp 110 is hermetically sealed 112. Within the sealed envelope are thermionic electrodes 114, 116 on solid wire leads 80, 82, 84 and 86 extending press sealed 119 from stems 115 and 117 respectively into the envelope, rare inert gasses 60% neon Ne, 40% argon Ar, and mercury vapor Hg, and two targets for amalgam formation, one of the targets, 106 is shown. The internal inert gas pressure and mercury vapor pressure are within the range known in mercury vapor discharge lamp manufacture for low pressure mercury vapor gas discharge tubes for example 2.5 torr and $6\times10^{-3}$ torr respectively, or for the kind of mercury vapor discharge lamp desired.

In construction of lamp 110, before sealingly attaching stems 115 and 117 to quartz tube 118, treatment of tube 118 which is 60 inches (1539 mm) long and 0.67 inches (17 mm) to 0.75 inches (19 mm) in diameter, Sylvania Osram type A, Grade SG25 quartz tubing may be used, includes:

Coat inside surface 120 of wall 122 of tube 118 with a 2% aluminum oxide water solution, and allow it to dry. Degussa Aluminum Oxide C for example, may be used.

Expose the tube to a lehr at about 1,100 degrees Fahrenheit to remove organic contamination.

Add nitrogen into the tube to blanket and exclude oxygen and other reactive gasses from a small area 128 of inside surface 120 of wall 122 10 inches from end 130 of the tube and heat the tube from the outside until the area is red hot, at least hot enough to assure fusion of the aluminum oxide with the quartz. A different inert gas may be used for excluding oxygen from area 128.

Under the nitrogen blanket apply to area 128 120 mg of indium from folded wire 99.998% pure, of about 1 mm diameter, 21 mm long, rubbed on the quartz using titanium wire while heating the area from the outside of the tube until the operation forms an approximately 1 cm diameter metal spot on the quartz surface that is wetted with the melted indium and titanium. This metal spot of indium and titanium is a target 106 for forming the mercury indium amalgam when the tube is hermetically sealed with mercury within the envelope.

Remove the heat and allow the target to cool under the nitrogen blanket.

A shiny metallic color indicates that the indium and titanium is sufficiently fused to the quartz envelope to make a permanently affixed mercury indium amalgam target.

To keep the titanium wire useful for another application, the titanium wire is kept within the nitrogen until the titanium wire cools down to prevent oxidation.

A second target is made as described above, 10 inches from end 132 of the tube.

Base 124, 126 of each stem is attached in hermetic seal to ends 130 and 132 of the tube. Resulting envelope 108 is evacuated through opening 140 in stem 117 and through exhaust tube 142. Then mercury, and the neon and argon are introduced into the envelope through exhaust tube 142 and opening 140. Exhaust tube 142 is then sealed.

Figure 5:
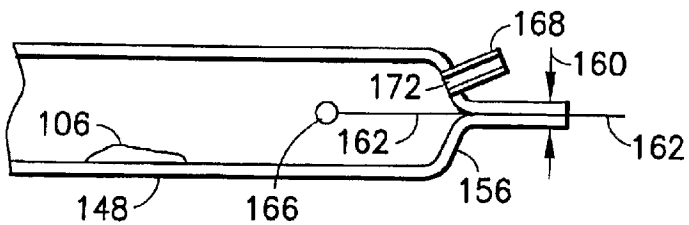
FIG. 5 is a schematic view of a seal on a mercury vapor lamp comprising the invention.

In FIG. 5, the end of the quartz tube 148 of a low pressure mercury vapor discharge lamp envelope 156 which contains target 106 of the invention is sealed by heating and pressing 160 the tube closed on wire leads 162 of electrode 166. The envelope is evacuated and filled with mercury and inert gas through quartz exhaust tube 168 which is fused around a hole 172 through the envelope after which exhaust tube 168 is sealed.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention.

Drawing Designators (Informal List)

Hg mercury
Ne neon gas
Ar argon gas
N nitrogen gas
20 quartz tube
24 nitrogen gas source
28 delivery tube
32 pipe
36 stopper, rubber
38 flows, arrow
42 indium wire
48 inner surface
50 quartz wall
52 clean area
54 flame
56 gas burner
60 outside surface
64 end of titanium wire
66 titanium wire
70 insulated sleeve
74 operator's fingers
80 wire lead
82 wire lead
84 wire lead
86 wire lead
90 element, sintered mixture
92 element, ribbon
106 target
108 envelope, elongated
110 lamp, germicidal
112 sealed
114 electrode
115 stem
116 electrode
117 stem

118 quartz tube
119 press seal
120 inside surface of tube 118
122 wall of tube 118
124 annular base of stem
126 annular base of stem
128 small area
130 end of tube 118
132 end of tube 118
140 opening in stem
142 exhaust tube
148 quartz tube
156 envelope
160 press seal
162 wire leads
166 electrode
168 exhaust tube
172 hole

What is claimed is:

1. A mercury vapor discharge lamp comprising:

a hermetically sealed envelope, a wall of said envelope comprising an elongated quartz tubular portion, at least one thermionic electrode, mercury vapor, and at least one inert gas in said envelope, aluminum oxide fused to the inside surface of the quartz tube, and an amalgam target comprising a metallic bond of indium metal and titanium metal fused together, fused to the fused aluminum oxide and quartz surface of said tubular portion exposed to the mercury vapor.

2. The lamp of claim 1 wherein said mixture is spaced from said electrode toward the center of said tubular portion.

3. The lamp of claim 1 being a low pressure mercury vapor discharge lamp.

4. In an elongated quartz envelope of a mercury vapor discharge lamp comprising an electrode in said envelope at one of said envelope:

mercury in said envelope, an amalgam target comprising a metallic bond of indium metal and titanium metal fused together, fused to a quartz wall of said envelope, spaced from said electrode toward the center of said envelope, exposed to the mercury.

5. A mercury vapor discharge lamp comprising:

a hermetically sealed envelope, a wall of said envelope comprising an elongated quartz tubular portion, at least one thermionic electrode, mercury vapor, and at least one inert gas in said envelope, and an amalgam target comprising a metallic bond of indium metal and titanium metal fused together, fused to the inside surface of quartz tubular portion, exposed to the mercury vapor.

6. The lamp of claim 5 being a low pressure mercury vapor discharge lamp.

7. The lamp of claim 5 comprising:

an amalgam of mercury with the metallic bond of indium and titanium target.

8. The lamp of claim 5 wherein said metallic bond of indium metal and titanium metal fused together is spaced along said tubular portion from said thermionic electrode.

9. A mercury vapor discharge lamp comprising:

a hermetically sealed envelope, a wall of said envelope comprising an elongated quartz tubular portion, at least one thermionic electrode, mercury vapor, and at least one inert gas in said envelope, and an amalgam target consisting of a metallic bond of indium metal and titanium metal, fused to the inside surface of said quartz tubular portion, exposed to the mercury vapor.

10. The lamp of claim 9 being a low pressure mercury vapor discharge lamp.

* * * * *